US008674896B2

(12) United States Patent
Lee

(10) Patent No.: US 8,674,896 B2
(45) Date of Patent: Mar. 18, 2014

(54) DIPOLE ANTENNA

(75) Inventor: Chang-Jung Lee, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 641 days.

(21) Appl. No.: 12/563,313

(22) Filed: Sep. 21, 2009

(65) Prior Publication Data

US 2010/0164824 A1 Jul. 1, 2010

(30) Foreign Application Priority Data

Dec. 25, 2008 (TW) ..... 97150709 A

(51) Int. Cl.
*H01Q 1/38* (2006.01)
*H01Q 9/16* (2006.01)

(52) U.S. Cl.
USPC ..... 343/795; 343/801

(58) Field of Classification Search
USPC ..... 343/700 MS, 795, 801
See application file for complete search history.

(56) References Cited

U.S. PATENT DOCUMENTS

| | | | | |
|---|---|---|---|---|
| 6,346,921 | B1 * | 2/2002 | Excell et al. | 343/792.5 |
| 6,956,536 | B2 * | 10/2005 | Lee | 343/793 |
| 7,126,540 | B2 | 10/2006 | Hsu et al. | |
| 7,129,904 | B2 * | 10/2006 | Chen | 343/795 |
| 2007/0052610 | A1 | 3/2007 | Lee | |

FOREIGN PATENT DOCUMENTS

| | | | |
|---|---|---|---|
| CN | 2655437 | Y | 11/2004 |
| CN | 1929204 | A | 3/2007 |

* cited by examiner

*Primary Examiner* — Michael C Wimer
(74) *Attorney, Agent, or Firm* — Muncy, Geissler, Olds & Lowe, P.C.

(57) ABSTRACT

A dipole antenna includes a substrate, a first conductive slice and a second conductive slice. The substrate has a first surface, a second surface and a first conductive hole. The second surface is disposed opposite to the first surface, and the first conductive hole passes through the first surface to the second surface. The first conductive slice is disposed on the first surface and has a feeding point. The second conductive slice is disposed on the second surface and has a ground point. The first conductive slice and the second conductive slice are disposed interlacedly and electrically connected to each other via the first conductive hole. The total length of the first conductive slice, the second conductive slice and the first conductive hole has to match the operating frequency of the dipole antenna.

8 Claims, 7 Drawing Sheets

DIPOLE ANTENNA

CROSS REFERENCE TO RELATED APPLICATIONS

This Non-provisional application claims priority under 35 U.S.C. §119(a) on Patent Application No(s). 097150709 filed in Taiwan, Republic of China on Dec. 25, 2008, the entire contents of which are hereby incorporated by reference.

BACKGROUND OF THE INVENTION

1. Field of Invention

The present invention relates to an antenna and, in particular, to a dipole antenna.

2. Related Art

Antenna is an important element for transmitting and receiving wireless signals in a wireless product; without it, the wireless product would not be able to work properly. Therefore, an antenna plays an essential role in wireless communication.

The rapid development of wireless communication brings various products and technologies of multi-frequency communication, and the new products provide with the functions of wireless communication to satisfy consumers' needs. Current demands for the products are not only the basic functions but also the additional functions such as global positioning system (GPS) service, Bluetooth communication, and Mobile Internet; this makes the process of choosing the antenna become more complex. Since these additional functions need to be carried out with hardware elements, the increasing number of such elements would take more space in the products with small sizes. Hence the space for the antenna would keep decreasing and at the same time, the antenna still needs to be properly integrated with other elements in the product.

Although there are various types of antennas, a dipole antenna is the most commonly used in wireless communication. FIG. 1 is a schematic view of a conventional dipole antenna. With reference to FIG. 1, a rectangular first conductive part 121 and a rectangular second conductive part 122 of the conventional dipole antenna 1 are disposed on a surface of a substrate 11. A conductive element 15 connects a feeding point 13 and a ground point 14 to feed the signal so as to generate the frequency resonance, such that the antenna could operate. However, because the conductive parts are disposed on only one surface of the substrate of the conventional dipole antenna, the size of the substrate will be increased if more conductive parts are added.

As mentioned above, it is difficult to reduce the size of the conventional dipole antenna. Therefore, the subject of the present invention is to design a dipole antenna with a reduced substrate size and the same functions.

SUMMARY OF THE INVENTION

In view of the foregoing, the present invention is to provide a dipole antenna having a substrate with reduced size.

To achieve the above, the dipole antenna of the present invention includes a substrate, a first conductive slice, and a second conductive slice. The substrate has a first surface, a second surface, and a first conductive hole. The first surface is disposed opposite to the second surface, and the first conductive hole passes through the first surface to the second surface. The first conductive slice is disposed on the first surface of the substrate and has a feeding point. The second conductive slice is disposed on the second surface of the substrate and has a ground point. The first and the second conductive slices are disposed interlacedly and electrically connected to each other via the first conductive hole. The total length of the first conductive slice, the second conductive slice, and the first conductive hole has to match the operating frequency of the dipole antenna.

As mentioned above, two conductive slices in rectangular shape of the dipole antenna according to the present invention are disposed on the first surface and the second surface of the substrate, respectively. By electrically connecting the first conductive slice and the second conductive slice via the first conductive hole, the number of paths for signal oscillation may be increased to reach the operating frequency, or the length of the substrate may be shortened to save space.

To achieve the above, the dipole antenna according to the present invention includes a substrate, a plurality of first conductive slices and a plurality of second conductive slices. The substrate has a first surface, a second surface, and a plurality of first conductive holes. The first surface is disposed opposite to the second surface and the first conductive hole passes through the first surface to the second surface. The first conductive slices are disposed on the first surface and at least one of them has a feeding point. The first conductive slices are disposed separately with a distance. The second conductive slices are disposed on the second surface and at least one of them has a ground point. The second conductive slices are disposed separately with a distance. The first conductive slices and the second conductive slices are disposed interlacedly and electrically connected to each other via the first conductive holes. The total length of the first conductive slices, the second conductive slices, and the first conductive holes has to match the frequency required for operating the dipole antenna.

As mentioned above, a plurality of first conductive slices in rectangular shape and a plurality of second conductive slices in rectangular shape of the dipole antenna according to the present invention are disposed on the first surface and the second surface of the substrate, respectively. The first conductive slices and the second conductive slices are electrically connected via the first conductive holes and disposed to the substrate linearly or in an arc shape. The first conductive holes may increase the number of paths for signal oscillation, such that the operating frequency of the dipole antenna may be reached or the length of the substrate may be shortened to save space.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

First Embodiment

Figure 1:
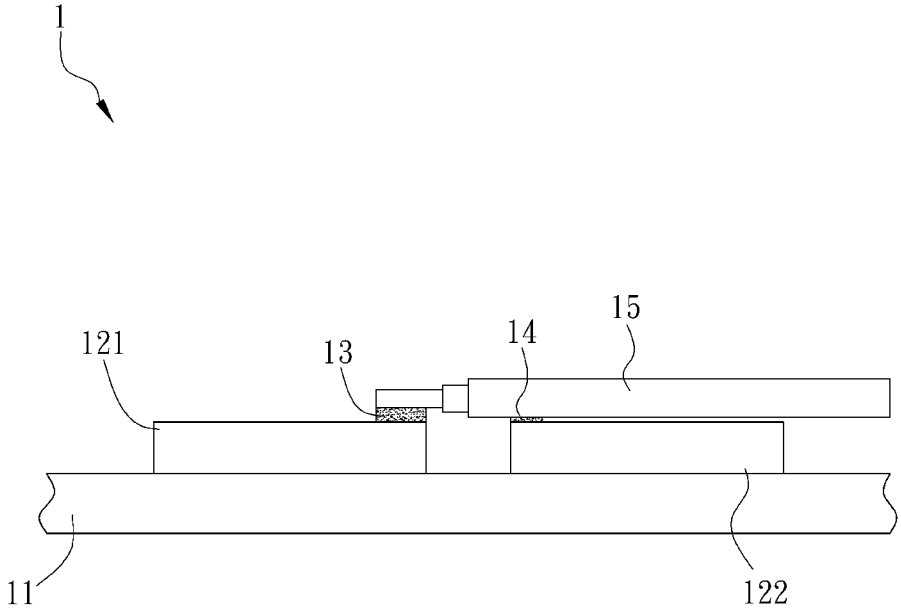
FIG. 1 (Prior Art)
FIG. 1 is a schematic view of a conventional dipole antenna.
Figure 2A:
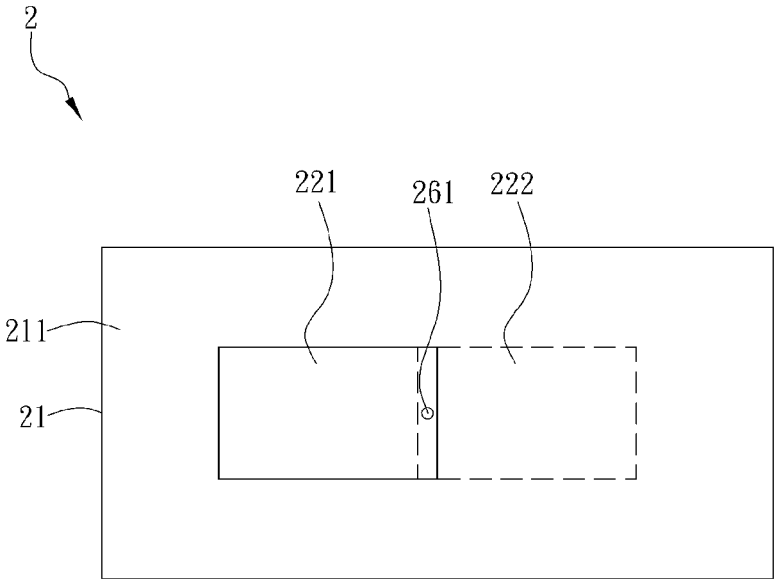
FIG. 2A is a schematic view of a dipole antenna according to a preferred embodiment of the present invention.

FIG. 2A is a schematic view of a dipole antenna according to a preferred embodiment of the present invention. With reference to FIG. 2A, the dipole antenna 2 includes a substrate 21, a first conductive slice 221 and a second conductive slice 222.

Figure 2B:
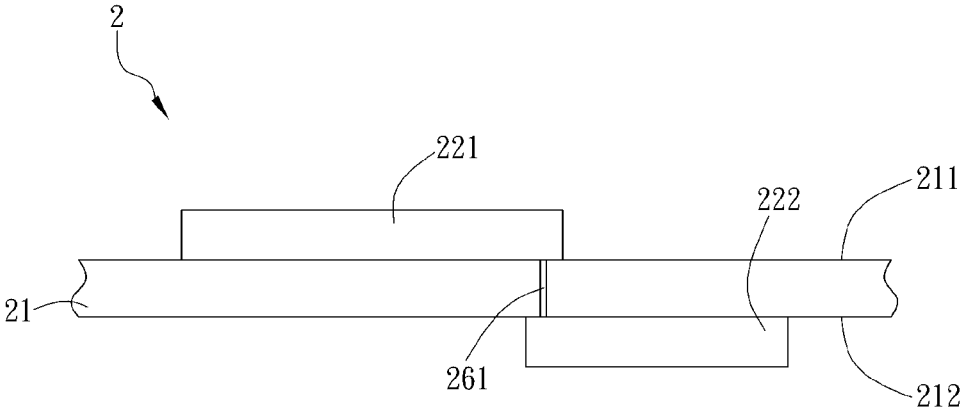
FIG. 2B is a side view of the dipole antenna according to the preferred embodiment of the present invention.

FIG. 2B is a side view of the dipole antenna according to the preferred embodiment of the present invention. With reference to FIG. 2B, the substrate 21 has a first surface 211, a second surface 212, and a first conductive hole 261. The first surface 211 is disposed opposite to the second surface 212. The first conductive hole 261 passes through the first surface 211 to the second surface 212. In the embodiment, the substrate may be a printed circuit board (PCB) made of bismaleimide-triazine (BT) resin or fiberglass reinforced epoxy resin (FR-4).

Figure 2C:
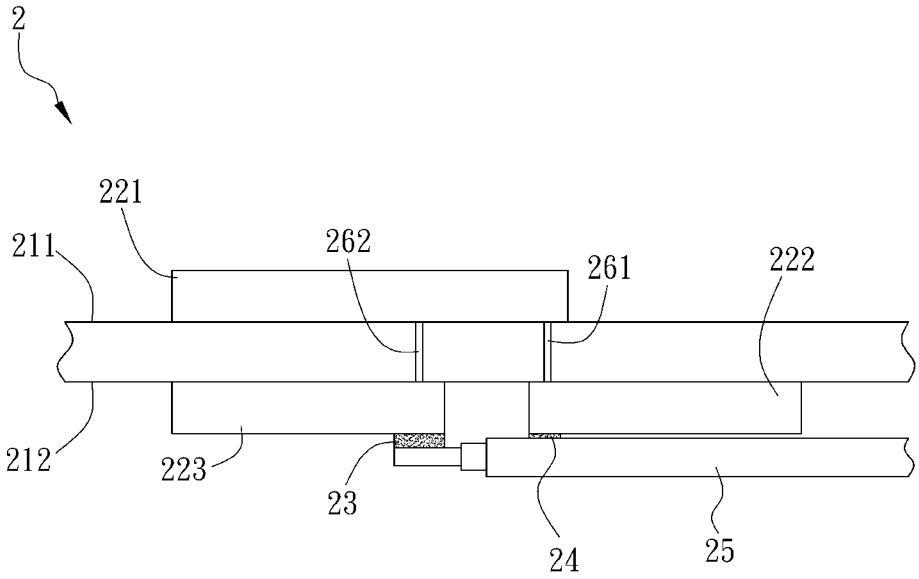
FIG. 2C is another side view of the dipole antenna according to the preferred embodiment of the present invention.

FIG. 2C is another side view of the dipole antenna according to the preferred embodiment of the present invention. With reference to FIG. 2C, the first conductive slice 221 is disposed on the first surface of the substrate 21 and has a feeding point 23, from which the signal is fed into the first conductive slice 221. The second conductive slice 222 is disposed on the second surface 212 of the substrate 21 and has a ground point 24. In the embodiment, the first conductive slice 221 and the second conductive slice 222 are rectangles with the same size or may be manufactured in various shapes or different sizes according to different demands. The materials of the first conductive slice 221 and the second conductive slice 22 may be Au, Ag, Cu, Pt, Al, Ni, Sn, Mg, or their combination.

In addition, the first conductive slice 221 and the second conductive slice 222 in the embodiment are disposed interlacedly on the substrate and electrically connected to each other via a first conductive hole 261 passing through the substrate; this increases the number of paths for signal oscillation. The total length of the first conductive slice 221, the second conductive slice 222 and the first conductive hole 261 is the path for signal oscillation of the operating frequency of the dipole antenna 2.

The dipole antenna 2 further includes a third conductive slice 223 disposed on the second surface 212 of the substrate 21. The first conductive slice 221 and the third conductive slice 223 are disposed correspondingly on the opposite sides of the substrate and electrically connected to each other via a second conductive hole 262, which means, the third conductive slice 223 also has a feeding point 23. In the embodiment, the third conductive slice 223 is a rectangle having a length smaller than that of the first conductive slice 221, such that the third conductive slice 223 is not electrically connected to the second conductive slice 222. The third conductive slice 223 may be manufactured in various shapes according to different demands. Moreover, the material of the third conductive slice 223 may be Au, Ag, Cu, Pt, Al, Ni, Sn, Mg, or their combination.

Additionally, in the embodiment, for feeding the signal to the dipole antenna 2, a conductive element 25 is further used to electrically connect the feeding point 23 of the third conductive slice 223 and the ground point 24 of the second conductive slice 222. The conductive element 25 may be a microstrip line or a coaxial transmission line.

Figure 3:
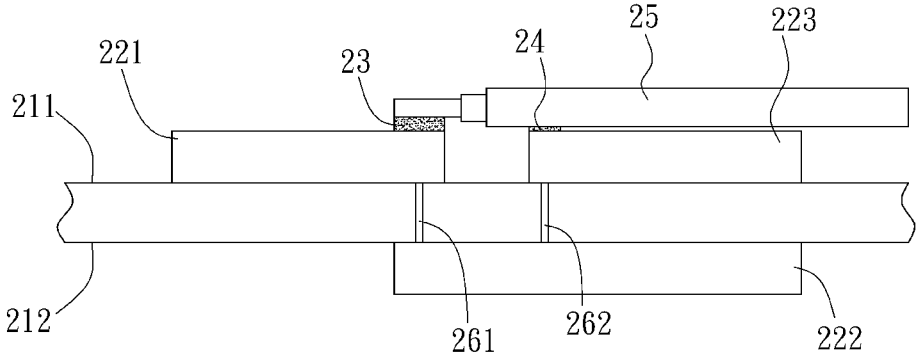
FIG. 3 is a side view of a dipole antenna according to a preferred embodiment of the present invention.

FIG. 3 shows a different aspect of a dipole antenna according to a preferred embodiment of the present invention. With reference to FIG. 3, the third conductive slice 223 may also be disposed on the first surface 211 of the substrate 21. The second conductive slice 222 and the third conductive slice 223 are disposed correspondingly on the opposite sides of the substrate 21 and electrically connected to each other via the second conductive hole 262, which means, the third conductive slice 223 also has the ground point 24. Furthermore, the conductive element 25 is electrically connected to the feeding point 23 of the first conductive slice 221 and the ground point 24 of the third conductive slice 223.

Second Embodiment

Figure 4A:
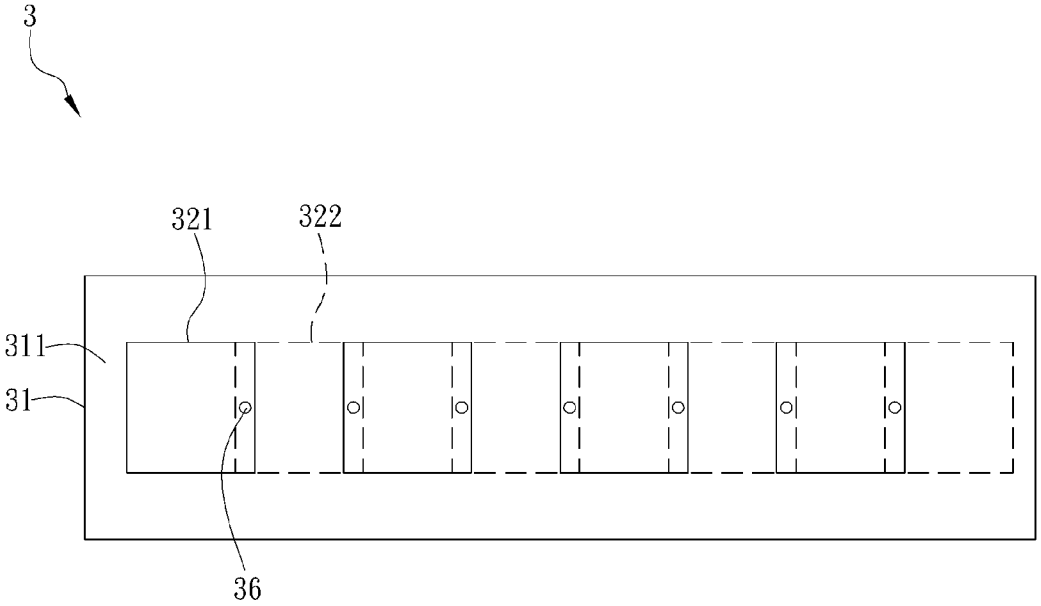
FIG. 4A is a schematic view of a dipole antenna according to a preferred embodiment of the present invention.

FIG. 4A is a schematic view of a dipole antenna according to a preferred embodiment of the present invention. With reference to FIG. 4A, the dipole antenna 3 includes a substrate 31, a plurality of first conductive slices 321, and a plurality of second conductive slices 322.

Figure 4B:
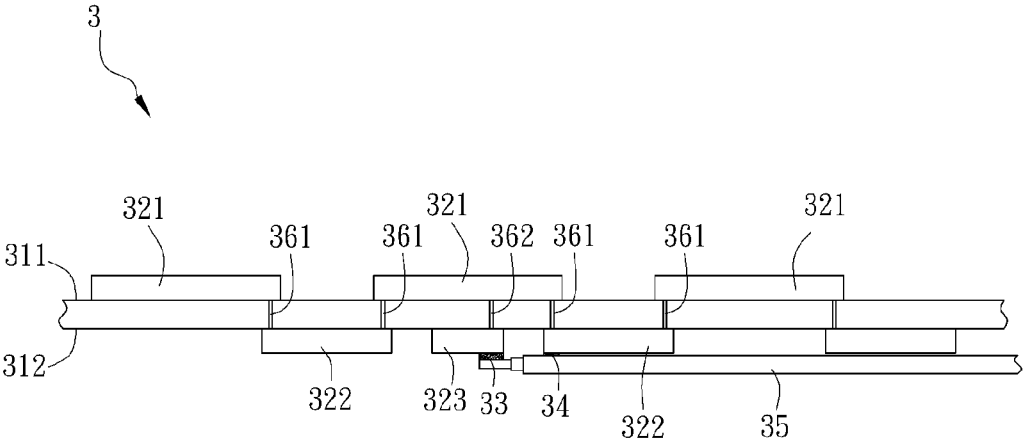
FIG. 4B is a side view of the dipole antenna according to the preferred embodiment of the present invention.

With reference to FIG. 4B, the substrate 31 has a first surface 311, a second surface 312, and a plurality of first conductive holes 361. The first surface 311 and the second surface 312 are disposed opposite to each other. The first conductive holes 361 pass through the first surface 311 to the second surface 312. In the embodiment, the substrate 31 may be a PCB made of bismaleimide-triazine (BT) resin or fiberglass reinforced epoxy resin (FR-4).

The first conductive slices 321 are disposed on the first surface 311 of the substrate 31. One of the first conductive slices 321 has a feeding point 33, from which the signal is fed into the first conductive slice 321. In a different aspect, more than one first conductive slice 321 may have the feeding point 33, and the first conductive slices 321 are disposed separately with a distance. In addition, in the embodiment, the first conductive slices 321 are rectangles in the same size, or may be manufactured in various shapes and sizes according to different demands. The material of the first conductive slices 321 may be Au, Ag, Cu, Pt, Al, Ni, Sn, Mg, or their combination.

The second conductive slices 322 are disposed on the second surface of the substrate 31. One of the second conductive slices 322 has a ground point 34. In a different aspect, more than one second conductive slice 322 may have the ground point 34, and the second conductive slices 321 are disposed separately with a distance. In addition, in the embodiment, the second conductive slices 322 are rectangles in the same size, or may be manufactured in various shapes and sizes according to different demands. The material of the second conductive slices 322 may be Au, Ag, Cu, Pt, Al, Ni, Sn, Mg, or their combination.

The first conductive holes 361 pass through the substrate for electrically connecting the first conducive slices 321 and the second conductive slices 322, and the first conductive holes 361 may also increase the number of paths for signal oscillation. The total length of the first conductive slices 321, the second conductive slices 322, and the first conductive holes 361 is the path for oscillation of the operating frequency of the dipole antenna 3.

In the embodiment, manufacturing process can be more advantageous as the distance between each of the first conductive slices 321 or between each of the second conductive slices 322 is the same and the lengths of these conductive slices are equal. The distance between the conductive slices does not have to be the same and the lengths may also be different if the total length of the dipole antenna 3 can match the required operating frequency. Moreover, in the embodiment, the first conductive slices 321 and the second conductive slices 322 are orderly disposed on the substrate 31 linearly or in arc shape.

The dipole antenna 3 further includes a third conductive slice 323, which is disposed on the second surface 312 of the substrate 31. The third conductive slice 323 is electrically connected to one of the first conductive slices 321 via the second conductive hole 362, which means, the third conductive slice 323 also has a feeding point 33. In the embodiment, the third conductive slice 323 is a rectangle having a length smaller than that of the first conducive slice 321, such that the third conductive slice 323 is not electrically connected to the adjacent second conductive slices 322. The third conductive slice 323 may be manufactured in various shapes according to different demands. Furthermore, the material of the third conductive slice 323 may be Au, Ag, Cu, Pt, Al, Ni, Sn, Mg, or their combination.

In addition, in the embodiment, for feeding the signal into the dipole antenna 3, a conductive element 35 is used for electrically connecting the feeding point 33 of the third conductive slice 323 and the ground point 34 of the adjacent second conductive slice 322. In this case, the conductive element 35 may be a microstrip line or a coaxial transmission line.

Figure 5:
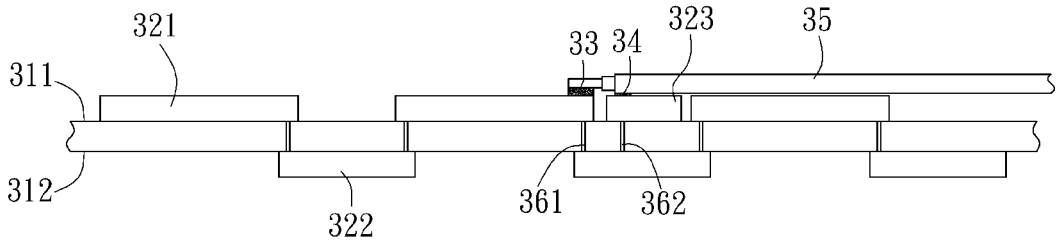
FIG. 5 is a side view of a dipole antenna according to a preferred embodiment of the present invention.

FIG. 5 shows a different aspect of a dipole antenna according to a preferred embodiment of the present invention. With reference to FIG. 5, the third conductive slice 323 may also be disposed on the first surface 311 of the substrate 31. The third conductive slice 323 is electrically connected to the second conductive slice 322 via the second conductive hole 362, which means the third conductive slice 323 also has the ground point 34. Furthermore, the conductive element 35 is electrically connected to the ground point 34 of the third conductive slice 323 and the feeding point 33 of the adjacent first conducive slice 321.

Figure 6:
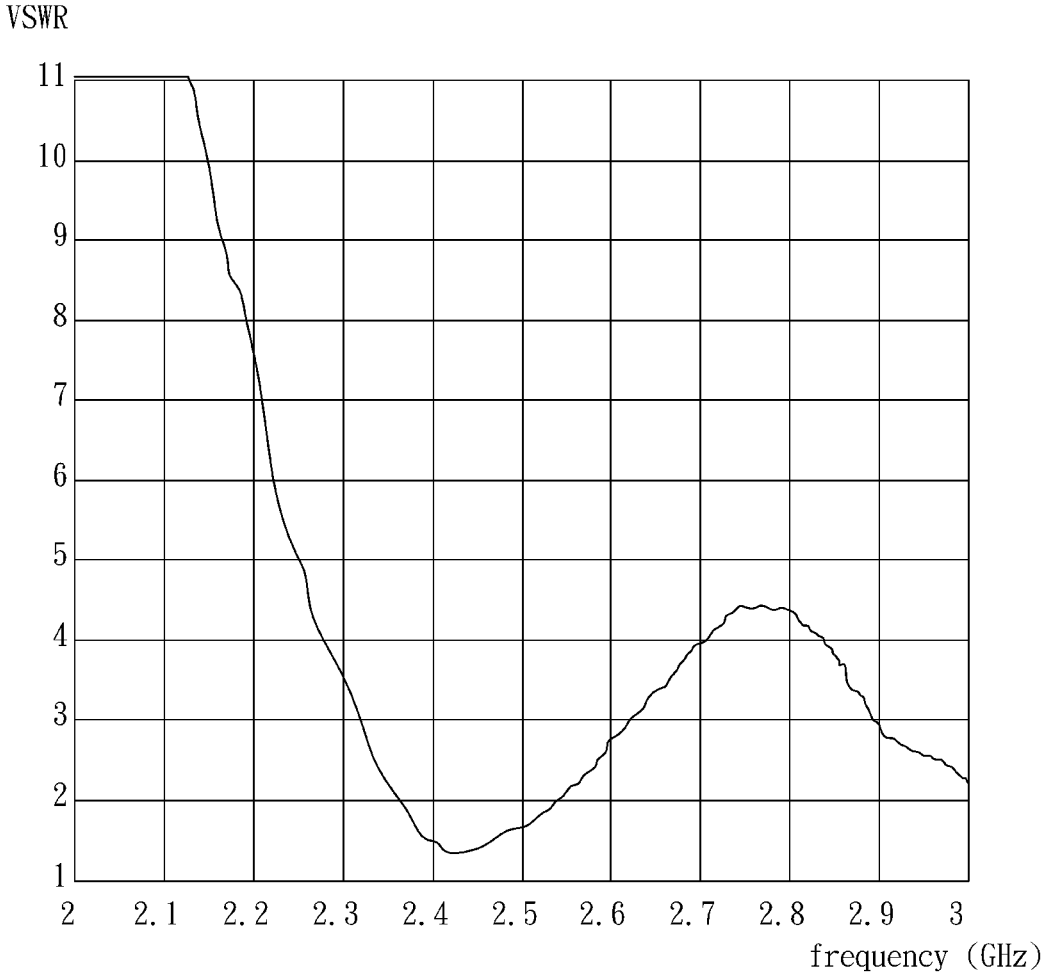
FIG. 6 is a graph of voltage standing wave ratio (VSWR) of the dipole antenna according to the preferred embodiment of the present invention.

FIG. 6 is a voltage standing wave ratio (VSWR) graph of the dipole antenna according to the preferred embodiment of the present invention. With reference to FIG. 6, the vertical axis represents voltage standing wave ratio (VSWR) and the horizontal axis represents frequency. Normally, the accepted VSWR is approximately 2. However, if it is smaller than 2, the dipole antenna may be operated between 2.35 GHz and 2.55 GHz in the present invention.

Figure 7:
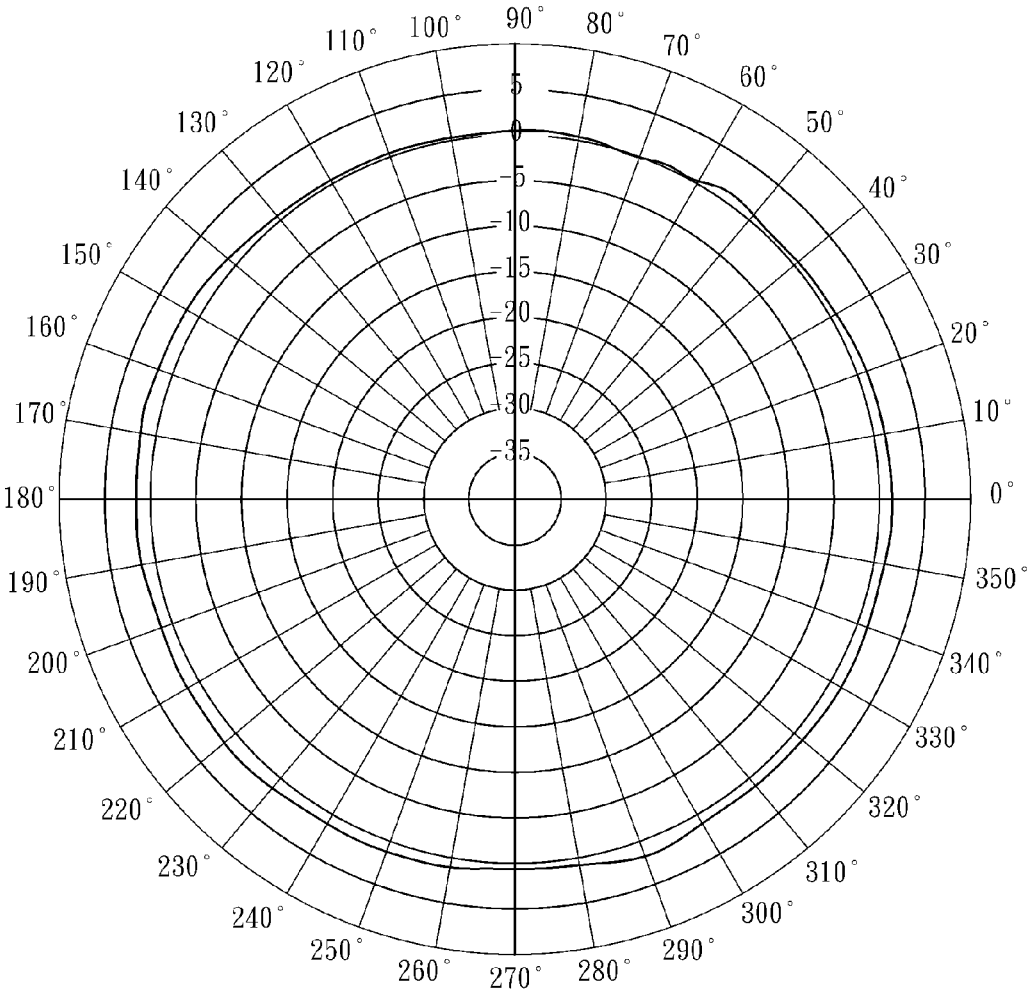
FIG. 7 is a graph of measuring results in radiation pattern of an H-Plane as the dipole antenna according to the preferred embodiment of the present invention operating at 2.45 GHz.
Figure 8:
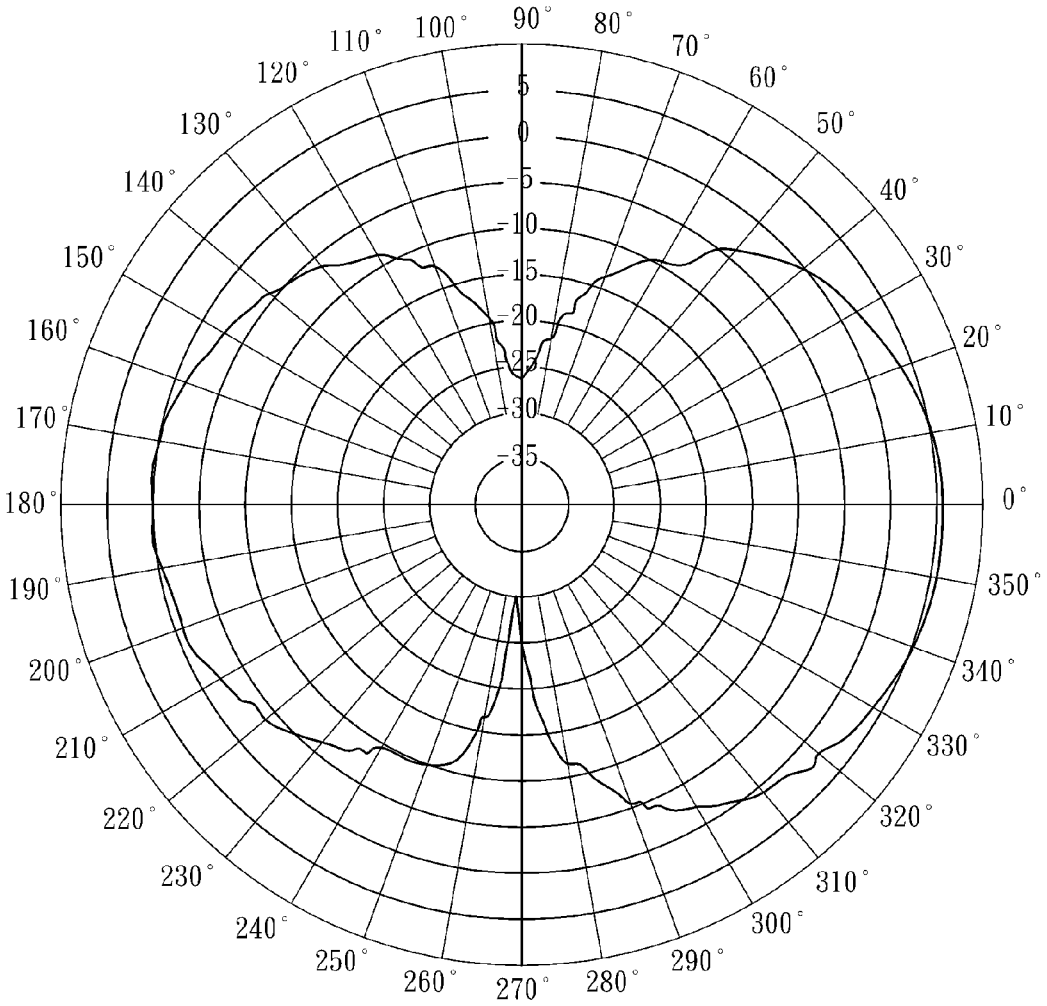
FIG. 8 is a graph of measuring results in radiation pattern of an E-Plane as the dipole antenna according to the preferred embodiment of the present invention operating at 2.45 GHz.

FIG. 7 is a graph of measuring results in radiation pattern of an H-Plane as the dipole antenna according to the preferred embodiment of the present invention operating at 2.45 GHz; and FIG. 8 is a graph of measuring results in radiation pattern of an E-Plane as the dipole antenna according to the preferred embodiment of the present invention operating at 2.45 GHz.

To sum up, in the dipole antenna according to the present invention, the first conductive slice is disposed on the first surface of the substrate, the second conductive slice is disposed on the second surface of the substrate, and the first conductive slice and the second conductive slice are electrically connected to each other via the first conductive hole, such that the number of paths for signal oscillation can be increased to reach the required operating frequency and the size of the substrate can be reduced so as to decrease the cost.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dipole antenna, comprising:

a substrate having a first surface, a second surface and a plurality of first conductive holes, the first surface disposed opposite to the second surface and the first conductive holes passing through the first surface to the second surface;

a plurality of first conductive slices disposed on the first surface, at least one of the first conductive slices having a feeding point and the first conductive slices disposed separately with a distance; and a plurality of second conductive slices disposed on the second surface, at least one of the second conductive slices having a ground point, the second conductive slices disposed separately with a distance, the first conductive slices and the second conductive slices disposed interlacedly and electrically connected to each other via the first conductive holes, wherein each of the second conductive slices is electrically connected to the two adjacent first conductive slices through the two first conductive holes, respectively, wherein the two adjacent first conductive slices extend toward opposite directions from the electrically connected second conductive slice, wherein the total length of the first conductive slices, the second conductive slices, and the first conductive holes matches an operating frequency of the dipole antenna.

2. The dipole antenna according to claim 1, wherein the substrate is a printed circuit board (PCB).

3. The dipole antenna according to claim 1, wherein the lengths of the first conductive slices are different or the same, or the lengths of the second conductive slices are different or the same.

4. The dipole antenna according to claim 1, wherein the distances between the first conductive slices are different or the same, or the distances between the second conductive slices are different or the same.

5. The dipole antenna according to claim 1, further comprising:

a third conductive slice disposed on the second surface of the substrate and electrically connected to one of the first conductive slices via a second conductive hole; and a conductive element connected to the third conductive slice and the ground point of the adjacent second conductive slice.

6. The dipole antenna according to claim 5, wherein the conductive element is a coaxial cable.

7. The dipole antenna according to claim 1, further comprising:

a third conductive slice disposed on the first surface of the substrate and electrically connected to one of the second conductive slices via a second conductive hole; and a conductive element connected to the third conductive slice and the feeding point of the adjacent first conductive slice.

8. The dipole antenna according to claim 7, wherein the conductive element is a coaxial cable.

* * * * *